US005397601A

United States Patent [19]

Korhonen

[11] Patent Number: 5,397,601

[45] Date of Patent: Mar. 14, 1995

[54] SIZE PRESS HAVING A DETACHABLE THROTTLE

[75] Inventor: Ville Korhonen, Jyväskylä , Finland

[73] Assignee: Valmet Paper Machinery, Inc., Helsinki, Finland

[21] Appl. No.: 11,414

[22] Filed: Jan. 29, 1993

[30] Foreign Application Priority Data

Jan. 30, 1992 [FI] Finland ..... 920414

[51] Int. Cl.[6] ..... B05D 3/12

[52] U.S. Cl. ..... 427/361; 427/356; 427/359; 427/364; 427/428; 118/410; 118/414

[58] Field of Search ..... 118/410, 414, 419; 427/356, 359, 361, 364, 428

[56] References Cited

U.S. PATENT DOCUMENTS

| | | | |
|---|---|---|---|
| 4,158,076 | 6/1979 | Wallsten | 427/294 |
| 4,396,648 | 8/1983 | Holt et al. | 427/356 |
| 4,405,661 | 9/1983 | Alheid | 427/356 |
| 4,534,309 | 8/1985 | Damarau et al. | 118/410 |
| 4,594,963 | 6/1986 | Krautzberger | 118/410 |
| 4,869,933 | 9/1989 | Sollinger et al. | 427/356 |
| 4,873,939 | 10/1989 | Eskelinen | 118/410 |
| 4,944,960 | 7/1990 | Sundholm et al. | 427/27 |
| 4,964,364 | 10/1990 | Karna et al. | 118/410 |
| 5,010,840 | 4/1991 | Busker et al. | 118/410 |
| 5,112,653 | 5/1992 | Damrau et al. | 427/356 |

FOREIGN PATENT DOCUMENTS

| | | |
|---|---|---|
| 81640 | 5/1988 | Finland . |
| 81637 | 7/1989 | Finland . |
| 911390 | 3/1991 | Finland . |
| 915964 | 12/1991 | Finland . |
| 416970 | 7/1987 | Sweden . |

OTHER PUBLICATIONS

R. Beisswanger und H. Sollinger, "Der Short Dwell Time Applicator (Kurze Verweilzeit zwischen Auftrag und Rakel) fur das Streichen von Paper und Karton, Wochenblatt Fur Papierfabrikatien", 23/24, pp. 887–892 (no month date) 1983.

*Primary Examiner*—Shrive Beck
*Assistant Examiner*—Katherine A. Baveford
*Attorney, Agent, or Firm*—Steinberg, Raskin & Davidson

[57] ABSTRACT

The invention relates to a method and device in a size press in which a nip is formed by a pair of rolls. A paper or board web is passed through the nip. The rolls are provided with surface-sizing units for applying films of size or coating agent onto faces of the rolls. Each surface-sizing unit comprises an application zone defined by a coating member, a front edge of the application zone and a feed chamber. The coating agent, such as a size, is fed, through holes or corresponding nozzles that have been formed into a wall of a feed pipe, into the feed chamber under pressure out of the feed pipe which is arranged transverse to the machine direction. The coating agent is fed out of the feed chamber into the application zone through a throttle placed between the feed chamber and the application zone. The throttle comprises a perforated plate or equivalent which extends across the width of the machine and which is detachably fixed to the frame constructions of the surface-sizing unit by fastening members.

18 Claims, 3 Drawing Sheets

SIZE PRESS HAVING A DETACHABLE THROTTLE

BACKGROUND OF THE INVENTION

The invention relates to a method and device in a size press which comprises a nip formed by a pair of rolls and through which a paper web or board passes. The rolls in the nip are provided with surface-sizing units for applying films of size or a coating agent onto faces of the rolls. Each surface-sizing unit comprises an application zone defined by a coating member, a front edge of the surface-sizing unit and a feed chamber. The coating agent, e.g., size, is fed under pressure out of a feed pipe into the feed chamber in a direction which is transverse to the machine direction through holes or corresponding nozzles formed into a wall of the feed pipe. The coating agent flows into the application zone from the feed chamber through a throttle placed between the feed chamber and the application zone. The application zone is opened toward the face of the roll onto which the size or coating agent is being applied.

In surface sizing of paper and board webs, a so-called short-dwell technique is commonly employed. In this technique, a thin size film is applied by a surface-sizing unit to the faces of rolls in a size press. The size film is transferred onto the paper or board in the roll nip. Generally either a blade or a spiral-grooved bar, or further developments of same, are used as a metering unit for the size film.

When smoothing the coating agent on the paper or board, possibly by means of a blade in a blade-coating technique, the thickness of the size film and, thus, the moisture profile of the web can be regulated by varying the blade pressure. When a spiral-grooved bar is used, e.g., in a bar-coating technique, the thickness of the size is usually regulated by varying the groove profile on the bar. However, in size presses, one of the most difficult problems has been exactly how to provide a uniform size or coating film on the roll face and how to profile the size film.

In the blade-coating technique as discussed above, the thickness of the size film is usually regulated by pre-stressing and regulating the pressure in a loading hose arranged behind the blade. In the bar-coating technique as well, attempts have been made to affect the thickness of the size film by regulating the pressure in the loading hose arranged behind a bar cradle which supports the coating bar. By regulating the pressure in the loading hose in either technique, it is possible to regulate the bending of the blade or loading of the bar against the roll face in a very convenient manner.

However, a loading hose generally lowers the precision of profiling, but nevertheless, it is often used because of its easy adjustability. The loading hose is placed between a particular profile rib and the coating blade or the cradle of the coating bar in the blade-coating or bar-coating technique, respectively. In this manner, the profiling is carried out by adjusting adjustable spindles which deflect the profile rib in the desired way. In such a case, the profiling is not particularly precise because the pressure is distributed evenly in the loading hose and therefore the movements of the adjusting spindles are not transferred to the coating member as such.

In size presses, the size is passed into the size feed chamber through a size feed pipe arranged transverse to the machine direction. The size feed pipe is provided with densely spaced perforations in order that the size should be introduced into the size feed chamber as evenly distributed as possible. Attempts have been made to eliminate any transverse flows out of the size feed chamber as completely as possible so that the profile of the size film should become as uniform as possible.

In order to provide an even size or coating film, in the prior art devices, a double flow distribution throttle is used. In such devices, a first throttle is formed by holes formed into the size feed pipe. A second throttle is formed by a throttle plate arranged in the size feed chamber. The size feed chamber is often provided with ribs which are generally arranged to face the holes in the size feed pipe. The ribs extend very close to the holes in the size feed pipe so that the ribs optimally guide the size to the application zone and also eliminate any transverse flows.

A significant drawback of such prior art devices has been the high cost of construction, because the size feed chamber must be constructed from acid-proof and polished stainless steel. Further, such devices should be constructed so that there should not be any dead-end pockets between the throttles, i.e. between the holes in the size feed pipe and the throttle plate. The reason for this particular construction is that it is extremely difficult to clean such pockets. To achieve this goal, the second throttle, i.e. the throttle plate, is arranged to pivot. However, it is another drawback that such a construction is very difficult and expensive to manufacture.

OBJECTS AND SUMMARY OF THE INVENTION

An object of the present invention is to provide a new and improved method and device used in a size press in which the drawbacks of the prior art devices are eliminated.

It is another object of the present invention to provide a new and improved method and device used in a size press in which a highly accurate profiling of the size or coating film is obtained.

It is yet another object of the present invention to provide a new and improved device in a size press in which a throttle plate can be easily removed for cleaning or replacement.

In view of achieving these objects and others, the present invention relates to a surface-sizing unit which includes a throttle which comprises a perforated plate, or equivalent, and extends across the width of the coating device. The throttle is fixed by fastening members to a frame construction of the surface-sizing unit so that it can be detached and replaced when desired. The surface-sizing units are arranged in proximity to a pair of rolls which form a nip through which a paper or board web passes to be coated with size.

Each surface-sizing unit comprises a coating member for coating the roll with size or a coating agent, a feed chamber for feeding the size or coating agent into an application zone, a front edge. The coating member, front edge and feed chamber define the application zone which is open towards the faces of the rolls. A feed pipe feeds the size or coating agent under pressure into the feed chamber and is arranged transverse to a machine direction of the size press. A wall of the feed pipe has holes or nozzles formed therein and arranged such that the size or coating agent flows through the holes or nozzles to the feed chamber. The throttle is arranged between the feed chamber and the application zone such that the size or coating agent flows from the feed chamber through the throttle to the application zone.

The present invention also relates to a method for applying the size or coating agent onto a paper or board in a size press, a nip is formed between a pair of press rolls. The coating agent or size is applied onto the rolls by arranging a feed pipe to feed the coating agent to a surface-sizing unit in a direction transverse to a machine direction. There is a surface-sizing unit arranged in proximity to each one of the pair of rolls. The coating agent is fed from the feed pipe to a feed chamber arranged in the surface-sizing unit through holes or nozzles formed in a wall of the feed pipe. Thereafter, the coating agent is fed from the feed chamber into an application zone defined between the surface-sizing units and the rolls through a detachable throttle. The throttle is provided with a plurality of perforations through which the coating agent flows into the application zone.

By means of the present invention, a number of significant advantages are obtained as compared with prior art devices. For example, in the device and method in accordance with the present invention, it is possible to completely omit the pivotal front plate of the beam with related devices, which have been used in the prior art devices. Thus, in the device in accordance with the present invention, a second flow distribution throttle is constructed as a perforated thin plate which can be arranged in its operating position in a simple way by placing the plate into grooves formed in the frame constructions of the device.

Moreover, in the present invention, the space between the throttles can be easily cleaned by pulling the throttle out from its location. The throttle used in the device and method of the present invention is inexpensive and easy to manufacture. When manufacturing the throttle, it is possible to use a cold-rolled or pre-polished band of a suitable material which does not need to be machined or polished. The perforations in the throttle plate can be made by any known process such as punching.

The extent of throttling in the device and method of the present invention can be easily adapted to different viscosities by simply replacing the throttle plate by another plate, in which the size of the perforations is different.

Other advantages and characteristic features of the invention will come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
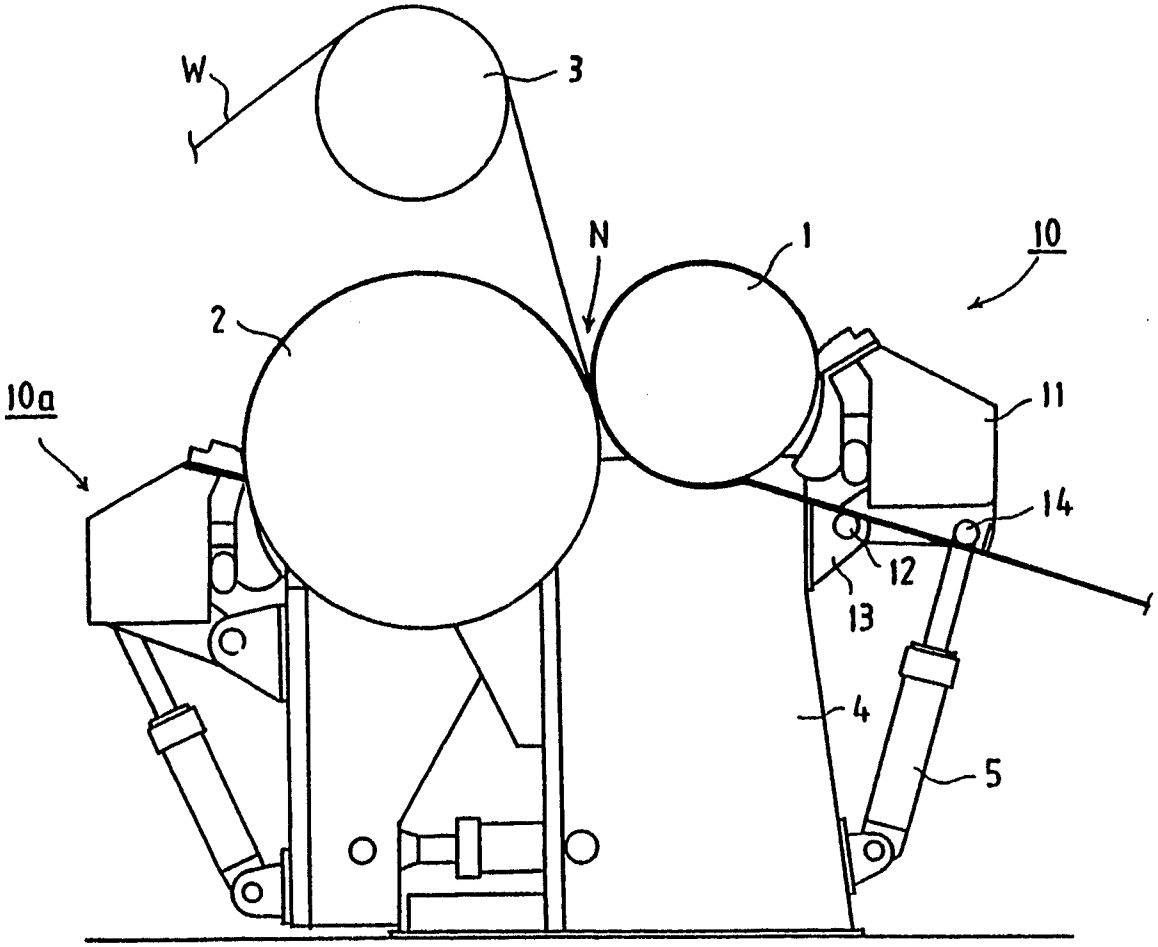
FIG. 1 is a schematic side view of a size press used in the device and method in accordance with the invention.

FIG. 1 is a schematic illustration of a size press which comprises size press rolls 1 and 2. The first press roll 1 and the second press roll 2 form a nip N with each other whereby a paper or board web W to be coated is passed through the nip. In the embodiment shown in FIG. 1, the web W is guided over a guide roll 3 into the nip N. In the size press, a first size film is metered onto a face of the first roll 1 by surface-sizing unit 10, and, in a corresponding way, a second size film is metered onto a face of the second roll 2 by surface-sizing unit 10*a*. The size films are transferred in the roll nip N from the faces of the rolls 1 and 2 onto the paper or board web W that runs through the nip.

Application beam 11 on the surface-sizing unit 10 is mounted pivotally on frame 4 of the size press by means of an articulation shaft 12 arranged transverse to the machine direction. A bracket 13 is arranged on the frame 4 of the size press for articulation of the application beam 11. The application beam 11 is further supported on the frame 4 of the size press by a loading cylinder 5 linked with the application beam 11 by an articulated joint 14. By means of loading cylinder 5, the application beam 11 can be pivoted in relation to the articulation shaft 12.

Figure 2:
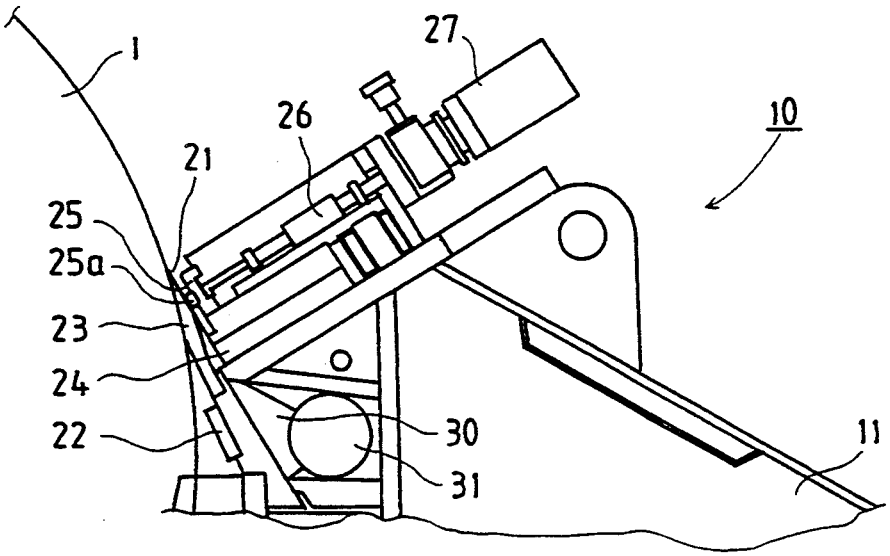
FIG. 2 is an enlarged illustration of a surface-sizing device in accordance with the invention as shown in FIG. 1.

Referring to FIG. 2, the spreading of the size or coating-agent film onto the face of roll 1 is carried out by means of a short-dwell technique. In this technique, the size or an equivalent coating agent is fed into application zone 23 in the surface-sizing unit 10. Application zone 23 is defined by a coating member 21, a front edge 22 of the surface-sizing unit 10 and by lateral seals (not shown). In a preferred embodiment, a slot is arranged between the front edge 22 and the face of the size press roll 1. Through the slot, overflow of the size or coating agent from the application zone 23 flows into a collecting basin.

Coating member 21 is mounted and fixed in a conventional way on a holder 24. A profile rib 25 is arranged behind the coating member 21 and rests against a rear face of the coating member 21. The rear face of the coating member 21 is connected by a loading hose 25*a* to the profile rib 25.

Adjusting spindles 26 are fixed to the application beam 11 by means of suitable fastening members. The adjusting spindles are arranged to be uniformly spaced in the transverse direction of the machine. A spindle motor 27, corresponding to each adjusting spindle 26, is mounted on the application beam 11. The adjusting spindles 26 are fixed to the profile rib 25 so that, by displacing the adjusting spindles 26, the profile rib 25 is pulled and/or pushed. In this manner, the profile rib 25 can bend in a desired manner. By bending the profile rib 25, it is possible to profile the coating member 21 and, thus, the size or coating-agent film to be applied to the face of the roll 1.

Figure 3:
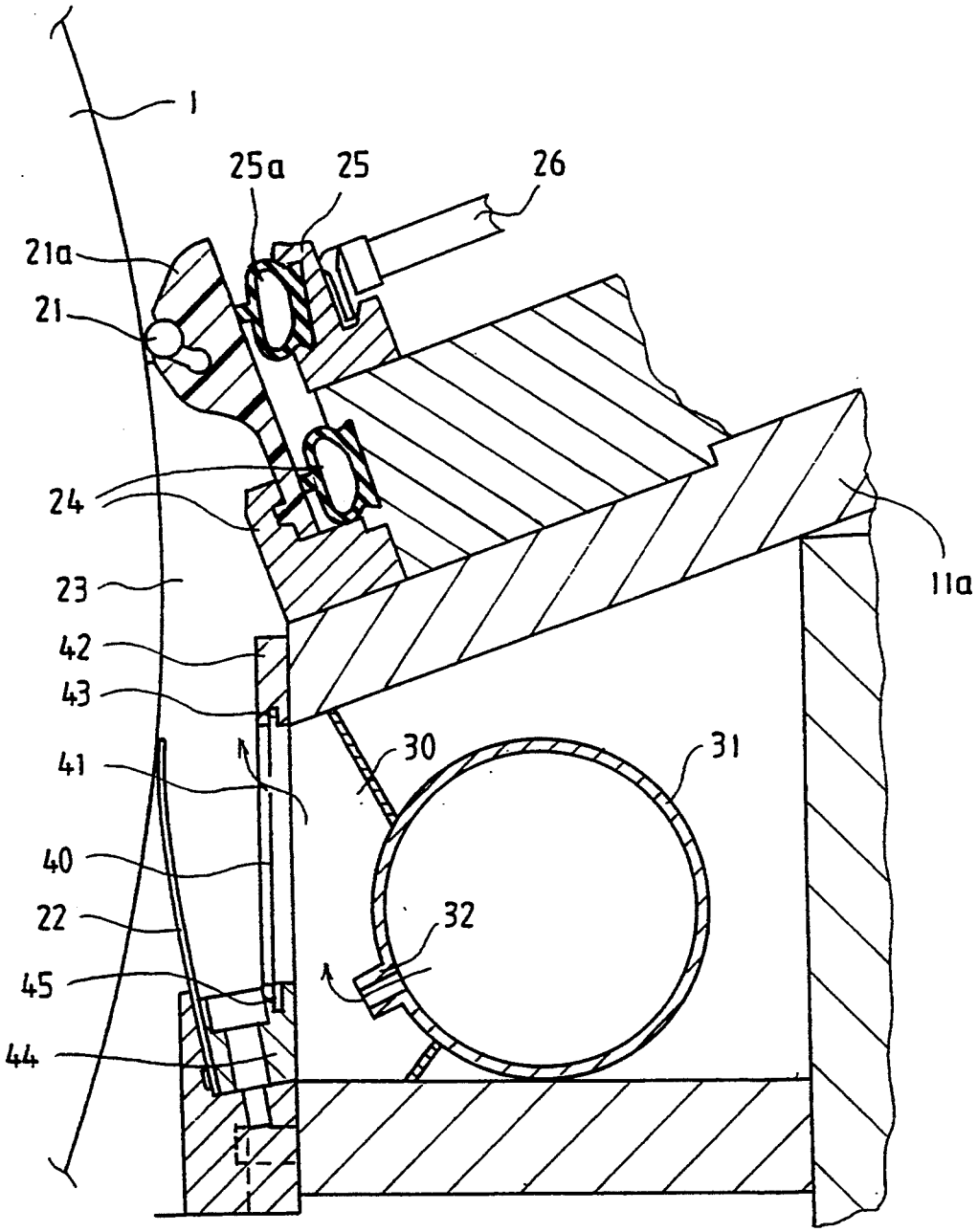
FIG. 3 is a further enlarged illustration of the embodiment illustrated in FIG. 2, which illustrates the construction of the surface-sizing unit in greater detail.

FIG. 3 is a more detailed illustration of the construction of the surface-sizing unit in accordance with the present invention. In the embodiment shown in FIG. 3, the coating member is a coating bar 21 which is revolvingly mounted in a bar cradle 21*a*. The coating bar 21 spreads and smooths the coating agent on the roll 1. A loading hose 25*a* is mounted in the profile rib 25 and rests against a rear face of the bar cradle 21*a*. The bar cradle 21*a* is mounted on the holder 24 in a manner known in the art. The loading hose 25*a* may be arranged so that it loads the bar cradle 21*a*.

In the embodiment shown in FIG. 3, the device in accordance with the invention is provided with a size feed pipe 31 placed in the transverse direction of the machine. The size or coating agent is fed into the feed pipe 31 preferably from both ends of the feed pipe 31. The feed pipe 31 is provided with a large number of holes, or corresponding nozzles, 32 in the transverse direction of the machine. These holes or nozzles 32 form the first throttle for the flow of the size or coating agent. Thus, the size or coating agent is passed from the feed pipe 31 through the holes or nozzles 32 and into the feed chamber 30. The size or coating agent is passed out of the feed chamber 30 further into the application zone 23.

Between the feed chamber 30 and the application zone 23, a second throttle is provided for further equalization of the flow. The second throttle comprises a plate 40 or equivalent, which extends across the width of the machine. A plurality of through holes 41 have been formed in the plate 40. Holes 41 are placed at a suitable distance from one another in the transverse direction of the machine. On the frame constructions 11*a* of the machine, fastening pieces 42,44 are mounted in the transverse direction of the machine. Fastening pieces 42,44 are provided with grooves 43,45 that extend across their length. The plate 40, or equivalent that comprises the throttle, is mounted in the grooves 43,45 in the fastening pieces 42,44 by pushing from a side of the machine. In this manner, the plate, or equivalent that comprises the throttle, can be easily detached, e.g., for cleaning, by pulling it out of the grooves 43, 45. In a corresponding way, the plate can be placed in its position simply by pushing from the side.

In the present invention, the extent of throttling can be readily adjusted for different viscosities by replacing the throttle plate 40, or equivalent, by another throttle plate 40 in which the size and/or the spacing of the holes 41 is/are different. The throttle plate 40 can be manufactured, e.g., out of a cold-rolled or pre-polished band of suitable material, which does not require any particular machining and which does not have to be polished. Holes 41 can be formed in such a plate by any method known in the art, e.g., by punching.

The examples provided above are not meant to be exclusive. Many other variations of the present invention would be obvious to those skilled in the art, and are contemplated to be within the scope of the appended claims.

I claim:

1. A method for applying a size or coating agent onto a paper or board in a size press, comprising the steps of:

forming a nip between a pair of press rolls through which a paper or board web runs, arranging a surface-sizing unit in proximity to each one of the pair of rolls, arranging a feed pipe to feed a coating agent into the surface-sizing unit in a direction transverse to a machine direction of the size press, feeding the size or coating agent from the feed pipe into a feed chamber in the surface-sizing unit through holes or nozzles formed in a wall of the feed pipe, providing a detachable throttle plate having perforations, opposite sides and lateral peripheral edges bordering said sides, said throttle plate extending transverse to the machine direction of the size press, arranging means in a direction transverse to the machine direction to receive said lateral peripheral edges of said throttle plate, feeding the coating agent from the feed chamber into an application zone defined between a front edge and a coating member of the surface-sizing unit through said perforations in said detachable throttle plate, and spreading and smoothing the coating agent fed into the application zone onto the rolls by means of a coating member arranged to contact a face of one of the rolls.

2. The method of claim 1, further comprising attaching the throttle to a frame constructions of the surface-sizing unit by means of fastening members such that the throttle is detachable upon release of the fastening members.

3. The method of claim 2, further comprising providing the fastening members with grooves extending across a machine width of the size press and arranging the throttle plate to fit into the grooves.

4. The method of claim 1, further comprising spacing the perforations in the throttle at a distance from one another in a direction transverse to the machine direction.

5. The method of claim 1, further comprising mounting the coating member to revolve in a bar cradle, mounting the bar cradle on a holder, mounting a loading hose on a profile rib, and arranging the loading hose to rest against a rear face of the bar cradle such that the loading hose loads the profile rib.

6. The method of claim 5, further comprising regulating a profile of the profile rib in the transverse direction of the machine by adjusting a plurality of spindles connected to the profile rib, such that profiles of the coating member and the coating agent applied onto the faces of the rolls are regulated.

7. The method of claim 1, further comprising feeding the coating agent into opposite ends of the feed pipe in the transverse direction.

8. The method of claim 1, further comprising changing the extent of throttling of the size or coating agent in said surface-sizing unit by replacing the throttle plate with another throttle plate having larger or smaller perforations therein.

9. A device in a size press in which a nip is formed by a pair of rolls and a paper or board web is passed therethrough to be coated with size or a coating agent, said device comprising surface-sizing units for applying films of size or coating agent onto faces of the rolls, each of said surface-sizing units comprising a front edge member and a coating member defining therebetween an application zone, said front edge member and said coating member being arranged in proximity to one of said rolls such that size or coating agent is applied to said one of said rolls in said application zone before said coating member in a running direction of said one of said rolls, said coating member spreading and smoothing the size or coating agent on said one of said rolls, a feed pipe arranged transverse to a machine direction of the size press, said feed pipe comprising a wall having holes or nozzles formed therein, said surface-sizing unit having a feed chamber defined therein, the size or coating agent flowing through said holes or nozzles in said wall of said feed pipe into said feed chamber, a throttle detachably connected to said surface-sizing unit and arranged between said feed chamber and said application zone, the size or coating agent flowing from said feed chamber through said throttle into said application zone, said throttle comprising a perforated plate having opposed sides and lateral peripheral edges bordering said sides, said throttle plate extending transverse to the machine direction of the size press, and fastening means extending transverse to the machine direction and comprising means for removably receiving said lateral peripheral edges of said throttle plate such that said throttle plate is detachable from said surface-sizing unit.

10. The device of claim 9, wherein said fastening means are provided with grooves extending transverse to the machine direction, said throttle plate being arranged to fit into said grooves.

11. The device of claim 9, wherein said throttle comprises a perforated plate formed from a band of material, perforations in said throttle being formed by punching holes in said throttle plate.

12. The device of claim 9, wherein said throttle is formed from a polished band of material in which perforations have been formed by punching holes in said throttle.

13. The device of claim 1, wherein said throttle plate is formed from a stainless steel.

14. The device of claim 9, wherein perforations in said throttle are placed at a distance from one another in the transverse direction of the machine.

15. The device of claim 9, wherein said coating member comprises a coating bar mounted on a bar cradle and arranged to revolve in said bar cradle, said device further comprising a holder on which said bar cradle is mounted, a profile rib arranged after said application zone in a running direction of the rolls, and a loading hose for loading said bar cradle, said loading hose being mounted on said profile rib and resting against a rear face of said bar cradle.

16. The device of claim 15, further comprising a plurality of adjustable spindles connected to said profile rib such that a profile of said profile rib can be regulated in a direction transverse to the machine direction by adjusting said spindles, and thus regulate profiles of said coating member and the size or coating agent applied onto the faces of the rolls.

17. The device of claim 10, wherein each of said plurality of adjustable spindles is separately adjustable.

18. The device of claim 9, wherein said throttle plate is formed from an acid-proof stainless steel.

* * * * *